US005493795A

United States Patent [19]

Bail

[11] Patent Number: 5,493,795

[45] Date of Patent: Feb. 27, 1996

[54] BALLAST REGULATOR HAVING IMPROVED TRACK CLEANING MEANS

[75] Inventor: Rama N. Bail, Montgomery, Ala.

[73] Assignee: Knox Kershaw, Inc., Montgomery, Ala.

[21] Appl. No.: 235,456

[22] Filed: Apr. 29, 1994

[51] Int. Cl.[6] ..... E02F 5/22

[52] U.S. Cl. ..... 37/104; 104/279; 15/55

[58] Field of Search ..... 37/104, 105, 106; 171/16; 104/7.3, 12, 279; 15/54, 55

[56] References Cited

U.S. PATENT DOCUMENTS

| | | | |
|---|---|---|---|
| 1,191,756 | 7/1916 | Baker | 37/104 |
| 1,469,464 | 10/1923 | Ursino | 37/104 |
| 2,374,312 | 4/1945 | Tackett | 37/104 |
| 2,463,499 | 3/1949 | Thornley | 37/104 |
| 2,624,130 | 1/1953 | Perier | 37/104 |
| 3,019,536 | 2/1962 | Kershaw | 37/104 |
| 3,034,236 | 5/1962 | Pyke | 37/104 |
| 3,468,042 | 9/1969 | Coy | 37/104 |
| 4,227,324 | 10/1980 | Thevrer | 37/104 |
| 4,257,331 | 3/1981 | Theurer et al. | 37/104 |
| 4,741,072 | 5/1988 | Wilkerson | 15/312 R |

*Primary Examiner*—Terry Lee Melius
*Assistant Examiner*—Victor Batson
*Attorney, Agent, or Firm*—C. A. Phillips

[57] ABSTRACT

A ballast regulator machine for dressing the ballast of a railroad bed during movement of the machine along tracks on the railroad bed has a frame for supporting various assemblies for distributing the ballast across the bed and ballast removal apparatus for removing ballast from between the rails to the outside of the rail which comprises a rotary broom assembly including a rotary broom for sweeping the ballast from between the tracks. The broom assembly is disposed for propelling the ballast rearwardly during the sweeping operation. A ballast deflector assembly is pivotally mounted to the rotary broom assembly and disposed for deflecting said rearwardly propelled ballast to the outside of the tracks. The deflector assembly is provided a baffle for deflecting the ballast in a direction which is substantially normal to the center line of the ballast machine.

11 Claims, 3 Drawing Sheets

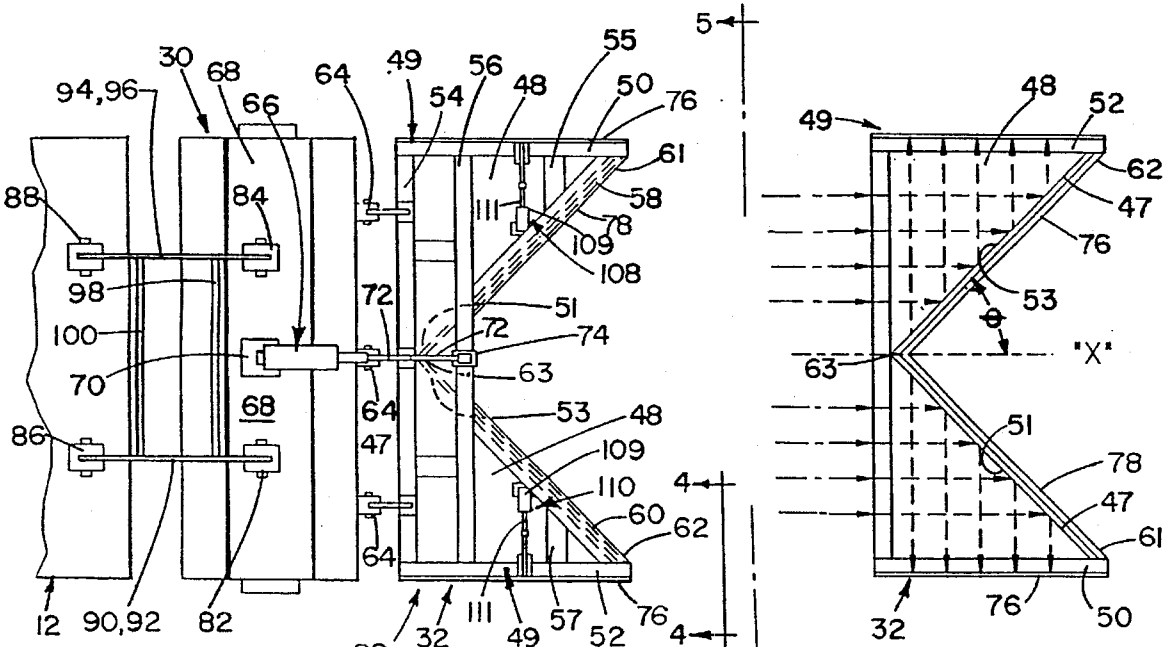
FIG. 2
FIG. 3
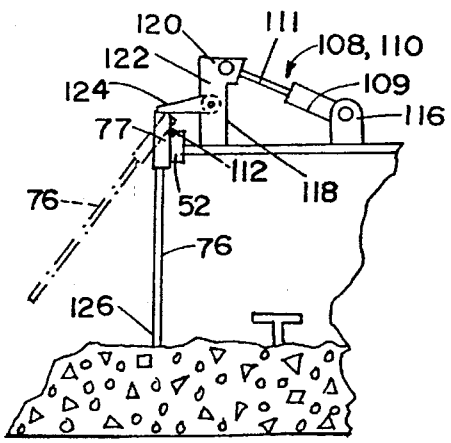
FIG. 4
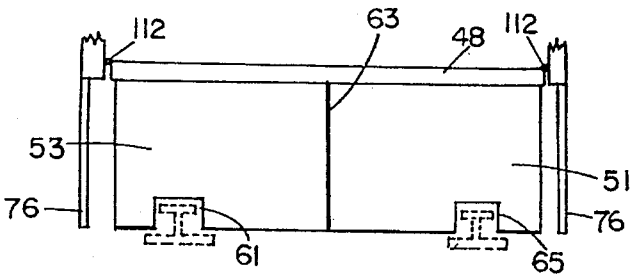
FIG. 5

BALLAST REGULATOR HAVING IMPROVED TRACK CLEANING MEANS

FIELD OF THE INVENTION

This invention is directed generally to ballast regulating machines which are movable along rails on a railroad bed to regulate ballast distribution on said bed and more particularly to such ballast regulating machines which utilize a rotatable broom assembly for final stage cleaning of the track bed.

BACKGROUND OF THE INVENTION

It is well known to provide ballast regulating machines to regulate the distribution and shaping of ballast on a railroad track bed. The apparatus of the present invention utilizes a plurality of assemblies mounted to a frame which is propelled along the track on track-engaging wheels which are driven by a motor carried on the frame. The ballast regulating apparatus includes a forward V-shaped plow which is mounted at the forward end of the frame to shape the ballast which has been deposited between the tracks of the railroad bed. The V-shaped plow also directs ballast from between the tracks to the shoulders of the bed. A pair of ballast wings are mounted (one on each side) on the frame to follow the V-shaped forward plow and to distribute and shape the ballast on the shoulders of the track bed. A final "clean-up" stage of the operation is provided by a track-cleaning apparatus which is comprised of a horizontally mounted rotatable broom assembly and a ballast deflector assembly. The broom sweeps the tracks to remove ballast therefrom and "throws" the swept ballast against a baffle in the deflector assembly which deflects the "thrown" ballast to the outside (shoulder) of the tracks. The baffle is simple in construction and includes a pair of surfaces which are mounted at substantially 45° to the axis of the machine so that ballast may impinge on these surfaces and be directed (at substantially 45° therefrom) to the shoulders of the railroad bed.

Typical ballast deflectors (as shown in FIG. 6) include a plurality of baffle plates which are mounted in the deflector assembly in spaced parallel relation with a central V-shaped baffle formed by a pair of baffle plates which are angled outwardly from an apex disposed at the forward portion of the deflector. It should be noted that ballast that is rearwardly propelled by the broom normally bounces back and forth between the baffle plates, and a substantial amount of rock falls back onto the track and track bed and must be again cleaned off. Applicant's baffle structure eliminates such shortcomings by utilizing a baffle which provides only a single pair of surfaces on each side of the axis of the deflector to deflect the rocks at substantially 45° and onto the bed shoulder. There are no additional intermediate baffle members which may intercept the moving rock once the rock has bounced off the baffle surfaces.

It is, therefore, an object of the present invention to provide a ballast removal apparatus which removes ballast from and in between the tracks of a railroad bed.

It is another object of the present invention to provide such ballast removal apparatus with means for directing the ballast removal from and in between the tracks to the shoulders of the railroad bed.

It is yet a further object of the present invention to provide such ballast removal apparatus with sweeping means which sweeps and propels the ballast on and between the tracks rearwardly of the ballast regulator machine.

It is still another object of the present invention to provide such ballast removal apparatus with a deflector assembly in which a single baffle directs the rearwardly propelled ballast to the shoulders in unimpeded fashion.

BRIEF DESCRIPTION OF THE DRAWINGS

FIG. 2 is a top elevational view of the broom assembly and ballast removal apparatus of the present invention.

FIG. 3 is a bottom view of the baffle assembly of the ballast removal apparatus of FIG. 1.

FIG. 4 is an elevational view taken along line 4—4 of FIG. 2.

FIG. 5 is an end elevational view as seen along line 5—5 of FIG. 2 and illustrates the ballast plate as being notched to clear the rails of the railroad track.

DESCRIPTION OF THE PREFERRED EMBODIMENT

Figure 1:
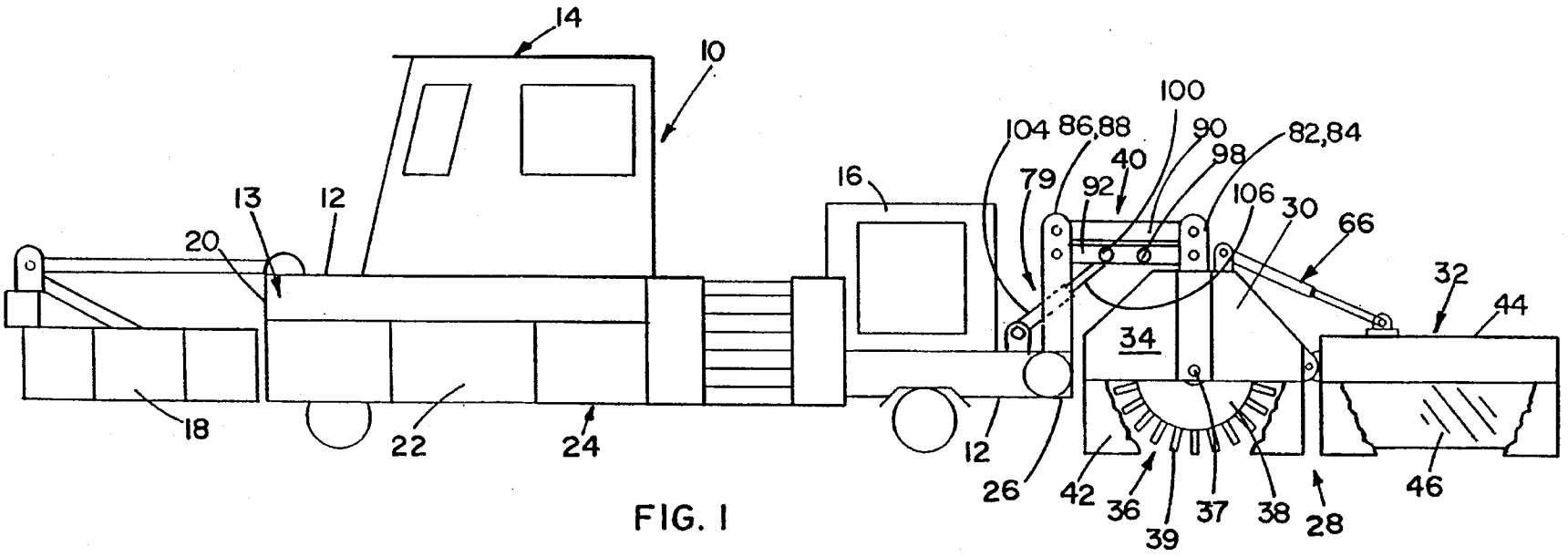
FIG. 1 is an elevational view of the ballast regulator of the present invention.
Figure 6:
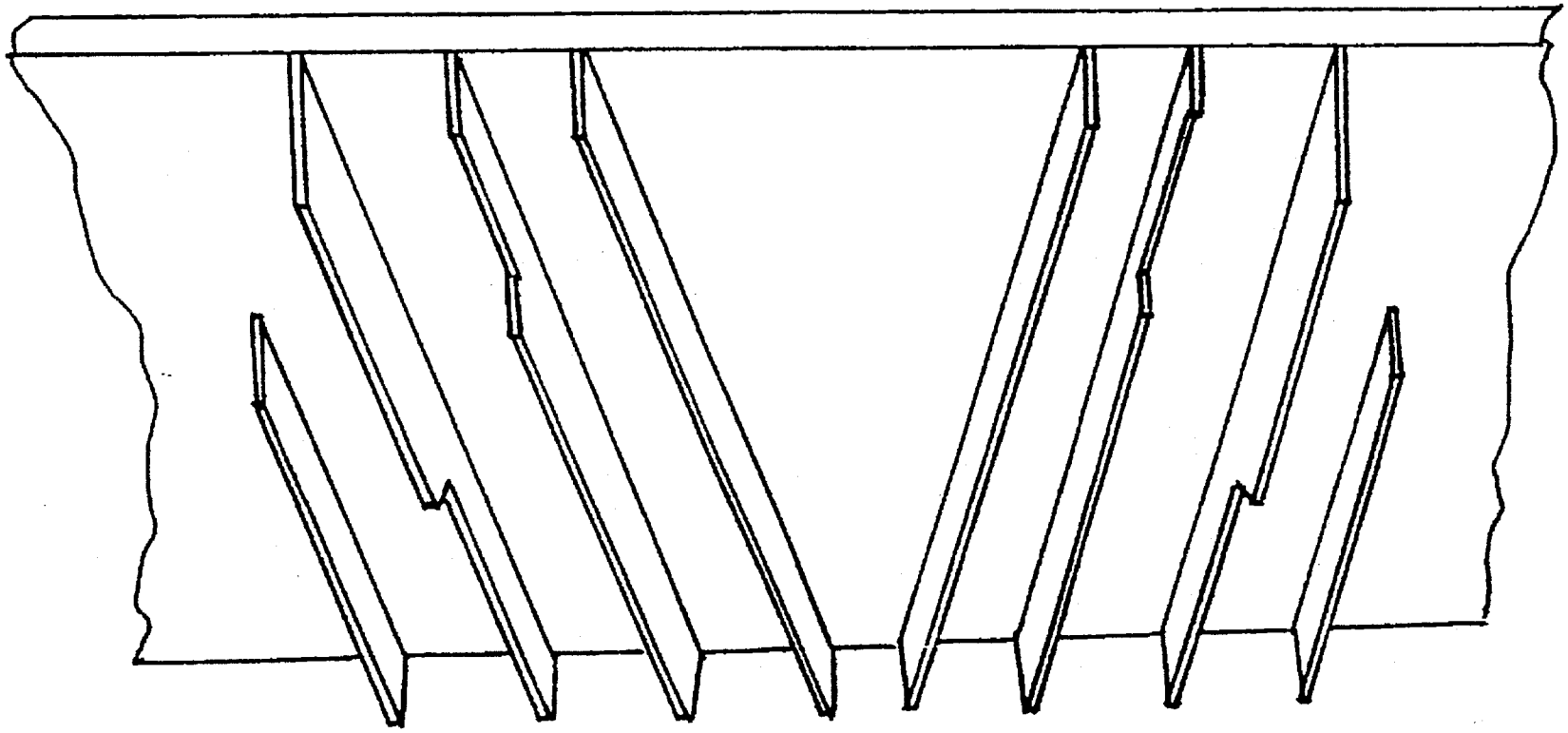
FIG. 6 (PRIOR ART)
FIG. 6 is a pictorial underside view of a prior art deflector.

A ballast regulator 10 (FIG. 1) is shown to include a frame 12 having a cab 14 secured to the forward portion 13 thereof. An engine compartment 16 is mounted on the frame 12 to the rear of cab 14. Also mounted on frame 12 is a forward plow assembly 18 which is mounted at the forward end 20 of the frame, a pair of side wing assemblies 22 (only one shown) which is mounted at the intermediate portion 24 of frame 12, and a ballast removal assembly 28 which is mounted at the rear end 26 of frame 12. The ballast removal (or clean up) assembly 28 includes a rotary broom assembly 30 and a ballast deflector assembly 32. As further seen in FIG. 1, the broom assembly 30 includes a housing 34 having a rotary broom 36 mounted on a shaft 37 which extends transversely across the housing. The broom 36 is a high efficiency, dual drive, low maintenance rotary drive mechanism which rotates a reel 38 having a plurality of radially extending bristles 39 mounted thereof. The bristles are made of reinforced solid rubber and are in the shape of rods. The broom assembly is mounted to frame 12 by a four-bar linkage assembly 40, discussed hereinbelow. The rotary broom may be enclosed by a protective skirt 42, shown broken away in FIG. 1 to better illustrate the bristles of the broom.

The deflector assembly 32 includes a housing 44 which supports a baffle structure 46. The deflector assembly includes an upper baffle support plate 48 (better shown in FIGS. 2 and 3) which is supported by a frame structure 49 comprised of a pair of side members 50 and 52 having a forward transverse support member 54, a transverse center support member 56, and a pair of transverse aft support members 55 and 57 secured thereto. A pair of support members 58 and 60 extend from center support member 56, in angled relation (substantially 45°), and have their respective ends 61 and 62 secured to side members 50 and 52. The baffle 47 may be comprised of a single plate bent at 45° to form a pair of deflector sections provided with deflector surfaces 51 and 53 which extend from an apex 63 at an angle θ (substantially 45°) to the center line (indicated by the letter "X") of the ballast regulator 10 and deflector assembly 32. Or, the baffle may be made of a pair of members secured to and extending from apex 63 (as by welding, etc.) to form deflector surfaces 51 and 53. The baffle plate is secured (as by welding, etc.) to the under surface of support plate 48 and depends therefrom.

FIG. 5 is a rear elevational view of the deflector assembly of the present invention as seen along line 5—5 of FIG. 2. As seen in FIG. 5, each of the surfaces 51 and 52 which extend from apex 63 is provided with cut-outs 61 and 65, respectively, to clear the rails. The rails are shown in dot-dash lines to illustrate the positions thereof in notched-out portions 61 and 65.

As can be best seen in FIG. 2, the deflector assembly is mounted in hinged, pivotal relation to the housing of the broom assembly by a plurality of spaced hinge assemblies 64. The deflector assembly is raised and lowered by a hydraulic cylinder assembly 66 which is secured between the housing of the deflector assembly and the broom assembly. FIG. 2 illustrates the cylinder assembly 66 as including a cylinder pivotally mounted on the upper surface 68 of the broom assembly housing by a hinge assembly 70. The cylinder is provided with a piston therein which moves a piston rod 72 which is pivotally secured to a rod support assembly 74 mounted on center cross member 56 to pivot the deflector assembly to up and down positions. The deflector assembly may be provided with pivotally mounted side skirts 76 on opposite sides thereof to prevent the ballast from being propelled beyond the skirt, as will be discussed hereinbelow. A rear skirt 78 is provided along the ballast regulator frame at the rear surfaces of support members 56, 58, and 60.

A hydraulic cylinder assembly 79 (FIG. 1) is provided for simultaneously raising and lowering the broom and deflector assemblies together. As stated supra, a four-bar linkage 40 connects the broom assembly and deflector assembly together. This four-bar assembly is shown in FIGS. 1 and 2 to include a first pair of support members 82 and 84 which are secured to the housing of the broom assembly and a second pair of support members 86 and 88 which are secured to frame 12 of the machine. A first pair of parallel bars 90 and 92 are respectively pivotally connected between the support members 82 and 86. A second pair of parallel bars 94 and 96 (FIG. 2) are respectively pivotally connected to support members 84 and 88. Cross members 98 and 100 are provided between the bars 92 and 96. To raise and lower the broom assembly 30 and the deflector assembly 32 together (for transportation, for example), the piston cylinder assembly 79 is pivotally connected between frame 12 and the four-bar assembly. As seen in FIG. 1, piston cylinder assembly 79 is shown to have its cylinder 104 pivotally connected to frame 12 and the piston rod 106 pivotally connected to cross member 100 of the four-bar parallel linkage 40. As discussed supra, the deflector assembly is also independently movable relative to the broom housing by piston-cylinder assembly 66. Such independent movement of the deflector assembly provides accessibility to the broom reel to permit servicing of the broom assembly, as necessary.

To control the distance that the ballast is propelled outwardly from the center of the tracks, the side skirts 76 are independently adjustable by piston cylinder assemblies 108 and 110. The piston cylinder assemblies are similar and include cylinders 109 and rods 111, and so are the mounting and linkages which connect the rods 111 (FIG. 4) to upper side plates 77 of each side skirt 76. The side plates 77 are each pivotally mounted to respective side support members 50 and 52 of the deflector assembly. Each skirt support plate 77 is pivotally supported on the respective support members 50 and 52 by a longitudinally extending hinge rod 112 which pivotally secures the side skirt support plate 77 to the respective side support members 50 and 52. The cylinder assemblies are mounted between a pair of upstanding support members 116 and 118 (FIG. 4). Member 118 pivotally supports a pivotally mounted L-shaped support member 120 which has the piston rod secured to the upper vertical end 122 of the "L" and the side plates 77 secured to the horizontal leg 124 of the "L."

The hydraulic cylinders 108 and 110 are connected hydraulically to a pump (not shown) which is controlled through a control panel (not shown) in the cab. The piston rod is pivotally connected to an upper portion of the L-shaped member and is movable to pivot the side plate about hinge rod 112 in a manner which rotates the bottom 126 of the skirt outwardly (as shown by the dashed lines in FIG. 4), thereby giving the operator on-the-fly control of the flow of the swept material.

I claim:

1. A ballast regulator machine for dressing the ballast of a railroad bed during movement of said machine along rails on said bed, said rails disposed in spaced relation and having a center line therebetween, said machine including a frame for supporting various assemblies for distributing the ballast across said bed and ballast removal means for removing ballast from between said rails to the outside comprising:

a rotary broom assembly including a rotary broom for sweeping the ballast from between said rails, said broom assembly disposed for propelling said ballast rearwardly thereof during a sweeping operation; and a ballast deflector assembly mounted adjacent to said rotary broom assembly, said ballast deflector assembly including a frame secured to said ballast regulator machine and baffle means defined by plate means rigidly secured and depending in non-movable relation from said frame, said plate means being defined by first and second angularly extending non-movable surfaces, said angular surfaces disposed for propelling said ballast away from said center line of said rails to the outside of said rails responsive to impingement of said ballast on said first and second surfaces responsive to said propelling of said ballast against said first and second surfaces by said rotary broom.

2. Apparatus as in claim 1 wherein said first surface is disposed at substantially 45° to the axis of said machine on one side of said deflector assembly and said second surface is disposed at substantially 45° to the axis of said machine on a second side of said deflector, said first and second surfaces disposed for propelling said ballast substantially normal to said center line.

3. Apparatus as set forth in claim 2 including deflector assembly side skirt means for impingement of said ballast thereon to limit the distance said baffle deflects said ballast on each side of said deflector.

4. Apparatus as set forth in claim 3 wherein said skirt means are adjustable to variably control the distance the deflected said ballast may travel.

5. Apparatus as set forth in claim 4 including first pivotally support means for pivotally supporting said broom assembly and said deflector assembly on said frame for first pivotal movement of said broom assembly and said deflector assembly relative to said frame of said machine, and first actuator means for providing the pivotal movement.

6. Apparatus as set forth in claim 5 including second pivotal support means for pivotally supporting said ballast deflector assembly on said broom assembly for independent pivotal movement of said deflector assembly relative to said broom assembly, and second actuator means for providing said pivotal movement to said deflector assembly relatively to said broom assembly.

7. Apparatus as set forth in claim 6 including means for independently adjusting each side skirt means.

8. Apparatus as set forth in claim 2 wherein said baffle means is comprised of a single plate bent at substantially 45° to form said first and second surfaces.

9. Apparatus as set forth in claim 2 wherein said baffle is comprised of a pair of plates formed at an apex with said first plate forming said first surface and said second plate forming said second surface, said plates mating at said apex.

10. Apparatus as in claim 9 wherein said plates are in secured relation at said apex.

11. Apparatus as in claim 2 wherein said rails have an upper surface and a base portion and wherein each of said surfaces of said baffle means is provided with a cutout portion to fit over said upper surfaces of said rails, whereby said lower surface of said baffle means extends below said upper surfaces of said rails to a position proximate said base portion of said rails.

* * * * *